2/4/86 OR 4,568,920

United States Patent [19]

Mombelli

[11] Patent Number: 4,568,920

[45] Date of Patent: Feb. 4, 1986

[54] METHOD AND DEVICE FOR SUPERVISING AND GIVING A PROGRESSIVE ALARM IN RESPONSE TO DETECTED INTENSITY

[75] Inventor: Paul Mombelli, Nice, France

[73] Assignee: ICB France Industrie et Composants du Batiment Societe Anonyme, Yzeure, France

[21] Appl. No.: 396,094

[22] Filed: Jul. 7, 1982

[30] Foreign Application Priority Data

Jul. 10, 1981 [FR] France ..... 81 13927

[51] Int. Cl.[4] ..... G08B 13/00

[52] U.S. Cl. ..... 340/566; 340/545; 340/547

[58] Field of Search ..... 340/585, 566, 65, 511, 340/537, 545, 547, 665, 683

[56] References Cited

U.S. PATENT DOCUMENTS

| | | | |
|---|---|---|---|
| 3,234,535 | 2/1966 | Schordine | 340/585 |
| 3,441,929 | 4/1969 | Coffer et al. | 340/585 X |
| 3,900,841 | 8/1975 | Buckles | 340/541 X |
| 4,057,791 | 11/1977 | Bimmerle et al. | 340/566 X |
| 4,198,625 | 4/1980 | Mondu et al. . | |
| 4,222,041 | 9/1980 | Von Tomkewitsch et al. | 340/505 X |

FOREIGN PATENT DOCUMENTS

| | | | |
|---|---|---|---|
| 2394858 | 1/1978 | France . | |
| 2485773 | 12/1981 | France | 340/566 |
| 1506387 | 4/1978 | United Kingdom . | |
| 2012092 | 7/1979 | United Kingdom . | |

*Primary Examiner*—James L. Rowland
*Assistant Examiner*—Brian R. Tumm
*Attorney, Agent, or Firm*—Wenderoth, Lind & Ponack

[57] ABSTRACT

The method and device employs detectors which are connected to electronic analyzers which, in accordance with the level of detection, actuate the corresponding level of alarm and the level of dissuasion by choosing the suitable timing and the suitable power circuit. The alarm is progressive and dissuasive so as to inform a provoker on the spot, in the region of the openings to be protected, that the system has detectors connected to an alarm center which is capable of analyzing the items of information coming from the detector or detectors and immediately actuating a specific and understandable alarm. The method and device are applicable to the supervision and protection of premises.

8 Claims, 1 Drawing Figure

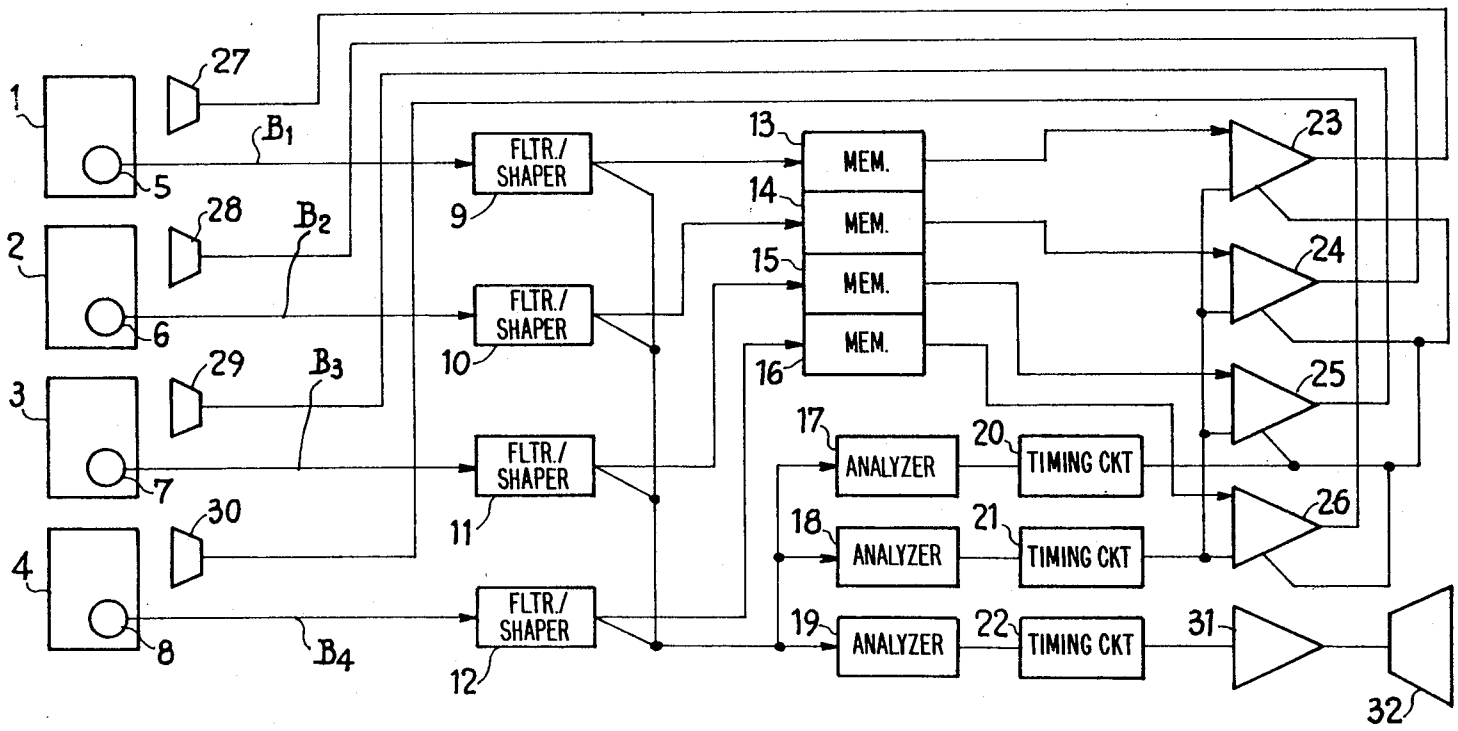
FLTR./ SHAPER
FLTR./ SHAPER
FLTR./ SHAPER
FLTR./ SHAPER
MEM.
MEM.
MEM.
MEM.
ANALYZER
ANALYZER
ANALYZER
TIMING CKT
TIMING CKT
TIMING CKT
B1
B2
B3
B4
1
2
3
4
5
6
7
8
9
10
11
12
13
14
15
16
17
18
19
20
21
22
23
24
25
26
27
28
29
30
31
32

METHOD AND DEVICE FOR SUPERVISING AND GIVING A PROGRESSIVE ALARM IN RESPONSE TO DETECTED INTENSITY

BACKGROUND OF THE INVENTION

The invention relates to a supervising and alarm method whose detection means are progressive in order to analyze the intensity of the breaking in and whose dissuasion and alarm means are progressive in intensity, in quality and in duration as a function of the detection.

Alarm systems constructed up to the present time are designed in accordance with roughly analogous functional diagrams.

One or more peripheral or volumetric detector loops are connected to the inputs of an alarm center. The alarm center has functions to supervise the various detectors in ways suitable to the principle of operation of each thereof and to set off the alarm when a disturbance is detected by a detector.

The alarm is given by various sound or light means or retransmitted over a distance by radio or telephone line. The sound warning means which are most usually employed as an alarm means are chosen in such a manner as to release a considerable amount of acoustic power which must be heard as far away as possible by the neighbors.

In the most sophisticated centers, an access loop permits the connection in a specific manner of the detector or detectors supervising the door through which the user will enter the premises under supervision. This permits avoiding the use of a lock contact placed outside the protected zone for connecting the system to the supply or stopping the system.

The user may thus enter by way of the door equipped in this way, without setting off the alarm. A pre-alarm, embodied by a light indicator or a buzzer of low sound level, will remind him to stop the center before the end of the time delay initiated by the opening of the door. If the center has not been stopped within the prescribed period, the alarm will be given.

In any cases, when a detector records a disturbance, the alarm will be given with all the powerful means provided for this purpose, either immediately for the normal loops or after a delay for the timed access loop.

The most serious problems created by alarm systems result from this feature common to all the presently-known systems. Indeed, security requirements combined with technological progress, encourage the installers to employ progressively sensitive detectors and to try to detect the attempted intrusions as early as possible and preferably before the intruder has entered the premises.

Unfortunately, in both cases, there is the same negative result: the proliferation of an ever larger number of accidental actuations. The difference between an attempted intrusion and a disturbance of atmospheric, electromagnetic or thermal origin is sometimes very slight or even non-existent. For example, the action of a violent wind on a badly-fitted door will be identical to that of the introduction of a crow-bar between the door and the frame for a detector operating under the effect of inertia placed on the door frame of the opening.

The effect of accidental actuations on the neighbors and on the users themselves is disastrous. They have an adverse effect on the value attached to an electronic alarm and give it a bad reputation in the eyes of potential clients.

Research workers and manufacturers of alarm equipment take great trouble to design more and more complex detectors in order to avoid these problems.

The present invention is the result of reflection on the finalities of electronic alarm systems. This type of alarm system is not intended to permit the capture of the burglars or thieves but to dissuade the latter from committing their crimes.

SUMMARY OF THE INVENTION

The method according to the invention and the device for carrying out the method avoid all the aforementioned drawbacks.

The very large majority of alarm systems are installed in premises of private individuals who are not the privileged targets of criminals, they are people who are quite well off but whose premises do not contain any treasure or collection of very high value.

Nothing specially designates them to the thieves, since the latter attack this type of victim all the more easily as the defenses they encounter are weak and do not constitute a danger to their own safety.

Thus, in respect of apartments in large buildings, it has been for a long time sufficient to provide the door with a lock a little better than those of the neighbors, with reinforcements at several points of the door frame to cause the intruders to avoid this door to the detriment of the less well defended neighboring doors. The generalization of this type of lock has resulted in an evolution of the intrusion methods and this is at the present time making the insurance companies inclined to prescribe an alarm as a means of defense. Now, if an alarm is to be just as dissuasive as multibolt locks have been for a long time, it must be noticed as soon as possible by the criminal and preferably before the latter has damaged the door.

It is here that the accidental actuations reappear!

The invention avoids all these drawbacks and resides in providing the openings it is required to supervise the well-chosen detectors operating by the effect of inertia, whose information will be processed by a really advanced electronic analyzer which disciminates with a maximum of safety between information coming from normal disturbances of the surroundings and those resulting from possible attempts to intrude.

As concerns the alarm center, at least two levels of detection are provided:

(a) a very sensitive level which initiates an action, e.g. when a neighbor unintentionally trips against the door mat placed against the door.

(b) a second less sensitive level, and consequently more reliable level, which initiates an action, e.g. solely upon the opening of the door.

The first level of detection will not result in the initiation of the general alarm, with the various means provided: siren, transmission over a distance etc. It will only indicate, by sound or light means of short duration and low level, that an electronic supervising system is installed on the opening and that it will be capable of initiating a much more powerful alarm if the attempted intrusion continues or progresses in intensity.

The dissuasive message will only be delivered within a very short radius about the opening and will not be noticed by the neighbors or by the user himself if he is present in his premises, awake or asleep, except of course when he is in the vicinity of the opening.

If, from time to time, an accidental actuation surprises the intelligence of the analyzer owing to the very high sensitivity of the detection, this will not create a dramatic situation among the neighbors, since it will not be noticed.

On the other hand, if an intrusion is continued, in spite of the dissuasion constituted by the warning produced by the first level of detection, the second level will come into action and will set off the most violent alarm.

Each detector will be accompanied by a buzzer or a light which will indicate the action of the first level of detection in the immediate vicinity of the protected opening without creating a disturbance in the immediate vicinity or in the premises.

The dissuasion will be nonetheless total. What intruder who happens to attack the opening will calmly continue his attempted intrusion after having been warned that the latter has been detected?

If it concerns an innocent passer-by who made a false step or hit the door too strongly, it is not a bad idea to inform him that a sophisticated supervising system watches over the opening and consequently doubtlessly over the whole of the premises.

The method according to the invention therefore comprises placing receivers whose items of information are processed by an electronic analyzer, which, as a function of the information, immediately sends back to the place of detection a dissuasive message signal informing the provoker that there is an electronic supervision which has already detected and understood the degree of the alert; if the detector or detectors are continued to be actuated at the same level of detection or at a higher level of detection, the dissuasive message is delivered within a larger radius, it may increase in duration and in intensity, while the electronic analyzer actuates an alarm which is progressive in duration and in intensity which exactly informs the interested parties of the type and state of advance of the breaking in.

The device according to the invention comprises detectors operative under the effect of inertia and providing items of informations which are sent to an electronic analyzer, this analyzer comprising at least two levels of detection, the first level being restricted to sending back immediately, by way of timing means and a power circuit, a dissuasive message signal to the provoker and therefore at the place of detection, the second level of detection acting on other circuits through another timing means and a power circuit which actuates one or more alarms in accordance with a graduation.

BRIEF DESCRIPTION OF THE DRAWING

The single FIGURE in the accompanying drawing relates to an operational diagram of a preferred practical embodiment of the center constituting the present invention.

DESCRIPTION OF THE PREFERRED EMBODIMENT

The openings to be supervised 1, 2, 3 and 4, are indifferently doors or windows. They are provided with detectors operative under the effect of inertia combined with magnetic contacts 5,6,7 and 8 in such manner that the wire loops $B_1$, $B_2$, $B_3$, $B_4$ which connect them to the center, which is the subject of the present invention, are permanently closed when the opening is closed and opened intermittently when the opening is subjected to vibrations or opened in a stable manner when it is opened.

Each loop $B_1$, $B_2$, $B_3$ and $B_4$ leads to respective circuits 9,10, 11 and 12 which carry out a filtering of the items of information and conserve those which correspond to mechanical vibrations recorded by their respective detector and reject those signals of electromagnetic or electric origin induced in the wires. The same circuits 9,10,11 and 12 shape the conserved signals so that they may be processed in logic stages.

Each circuit 9,10,11 and 12 is connected to a memory of specific localization 13,14,15 or 16 which conserves the information giving the origin of the signal which reduced the center. These members 13,14, 15 or 16 are cyclically re-set so as to conserve solely the items of information corresponding to the signals which are being processed in the analyzers 17,18 and 19. The first analyzer 17 is very sensitive and it can be actuated by a vibration of a small amplitude. The second analyzer 18 is of medium sensitivity and it responds only to rather violent impacts on the opening. The analyzers 17 and 18 which are initiated by weak or medium signals bring into action dissuasive means which are perceived only in the very immediate vicinity of the point 1,2, 3 or 4 where the signal is produced and are not heard by the immediate neighbors and the occupants of the premises to be protected.

The third analyzer is only slightly sensitive and requires signals of long duration which only the magnetic contacts are able to generate. The three analyzers 17, 18 and 19 simultaneously receive all of the signals issuing from the circuits 9, 19, 11 and 12. Depending on the intensity of the disturbance acting on the opening, none will be initiated, or only the most sensitive analyzer 17, or the analyzers 17 and 18, or the analyzers 17, 18 and 19.

When the threshold of an analyzer is reached, the latter actuates a following circuit which determines the duration during which the dissuasive action will occur. The three timing circuits 20, 21 and 22 follow respectively on the analyzers 17, 18 and 19. Each is adjustable to its own value of time. The circuit 20 corresponding to slight disturbances will order an action of a few seconds. The circuit 21 corresponding to medium and strong impacts, will act for a slightly longer time. The circuit 22 corresponding to distinct intrusions, will initiate a dissuasive action of one to three minutes, the latter value being the legal maximum allowed for the operation of a siren or in a public thoroughfare.

At this stage of the description of FIG. 1, the device effects a selection among the signals issuing from the detectors 5,6,7 and 8 mounted on the openings and sets off three types of distinct actions of different duration.

The very sensitive channel, constituted by the analyzer 17 and the timing means 20, will act in parallel on the four power circuits 23, 24, 25 and 26 respectively connected to the dissuasive devices 27, 28, 29 and 30.

The power circuits are driven, through the timing means 20, at an input releasing the available semi-power. They are permanently inhibited and solely released under the action of the corresponding memory 13, 14, 15 or 16. Thus, only the dissuasive element placed close to the opening which has been shaken by the vibration will receive the semi-power initiated by the sensitive analyzer 17.

The medium sensitivity channel, constituted by the analyzer 18 and the timing ciruit 21, will act on the four power circuits simultaneously, but this time, on an input releasing the full power. And, as before, only the circuit corresponding to the disturbed opening will be rendered operative by the memory pertaining thereto. The dissuasive action will be carried out under the same conditions as for the very sensitive channel, but with a higher intensity and a longer duration.

If several openings are attacked simultaneously, the dissuasive means pertaining thereto will come into action simultaneously.

When the medium sensitivity channel is rendered active, the sensitive channel is also of course rendered active at the same time. The dissuasive action of the medium channel is superimposed on that of the sensitive channel by a higher intensity and a longer duration.

If the analyzer 19 is actuated by a disturbance corresponding to a veritable intrusion, it will act on the timing circuit 22 which will actuate its respective power channel 31. The latter will actuate the dissuasive device 32 which is connected thereto. The latter may be formed by one of the known sound or light apparatus or by one of the known apparatus transmitting over a distance or by a combination of a plurality thereof.

The duration of an action in the case of a siren shall be between one and three minutes, as explained hereinbefore.

The opening which was subjected to the intrusion will receive the dissuasive alarm under the conditions explained in the preceding paragraph concerning the medium sensitivity channel 19 and 22.

The dissuasion means 27, 28, 29 and 30 may be of different types. Thus, they may be of the light or sound type and in particular it may concern a vocal message recorded on a magnetic support or produced synthetically by an electronic circuit.

Having now described my invention what I claim as new and desire to secure by Letters Patent is:

1. In a supervising and alarm device comprising a means for detecting vibrations undergone by closing means of exits or openings of premises to be supervised, a means for assigning to said vibrations at least two levels respectively corresponding to at least two intensities of vibrations and a means for producing a general alarm signal in response to the highest intensity of vibrations; the improvement comprising a means for producing a warning and dissuasion signal for a predetermined period of time in response to vibrations corresponding at least to the lowest level of intensity, said signal being intended for the person who had caused said vibrations and produced at the exit or opening location where said vibrations have been produced; wherein said means for detecting vibrations are detectors which are operative under the action in inertia and are each associated with the respective closing means of an exit or opening, said means assigning levels to the vibrations comprising analyzers, each of which analyzers is connected to a respective one of said detectors; said device further comprising: timing circuits which are respectively connected to said analyzers for determining the period during which said general alarm signal and/or warning and dissuasion signals are produced as a function of the level of the detected vibrations; and wherein exits or openings to be supervised are provided with said detectors which are operative under the action of inertia and are combined with magnetic contacts in such manner that wire loops which interconnect them are permanently closed when its corresponding exit or opening is closed and are intermittently opened when its corresponding exit or opening is subjected to vibrations or are permanently opened when the exit or opening is opened, each loop comprising a filtering circuit for passing information signals which correspond to mechanical vibrations detected by the detector and for eliminating noise signals of an electromagnetic or electric origin induced on said wire loop, said filtering circuits including shaping circuits for shaping said passed signals; and wherein each shaping circuit is connected to a memory means for storing an information signal coming from the corresponding detector, said memory means including means for cyclically resetting themselves so as to solely store said information signal corresponding to the signals which are being processed in the analyzers, said memory means also authorizing the corresponding means for producing a warning and dissuasion signal.

2. A device according to claim 1, further comprising power circuits through which said timing circuits for determining the period during which said warning and dissuasion signals are produced are connected to the corresponding means for producing said warning and dissuasion signal; said timing circuits having outputs connected in parallel to corresponding inputs of said power circuits, which power circuits further comprise authorization inputs respectively connected to outputs of said memory means.

3. A device according to claim 2, wherein the timing circuit connected to the analyzer of signals corresponding to the lowest level of vibrations is connected in parallel to inputs of the power circuits adapted to bring into action one half of the power of said power circuits.

4. A device according to claim 3, wherein a medium sensitivity channel comprising the analyzer of signals corresponding to the medium level of vibrations and its corresponding timing circuit, acts on the power circuits simultaneously at an input bringing into action the full power of said power circuits.

5. A device according to claim 2, wherein a medium sensitivity channel comprising the analyzer of signals corresponding to the medium level of vibrations and the corresponding timing circuit, acts on the power circuits simultaneously at an input bringing into action the full power of said power circuits.

6. A device according to claim 1, wherein upon a simultaneous agression on a plurality of exits or openings, each corresponding dissuasion means is actuated by the highest level of vibrations detected by its means for detection.

7. A device according to claim 1, wherein there are three of said levels of vibrations, and the analyzers are three in number, a first analyzer being very sensitive, a second analyzer being of medium sensitivity and a third analyzer being of low sensitivity and arranged so as to require signals of long duration in order to operate.

8. A device according to claim 1, wherein the actuation of the analyzer of signals corresponding to the highest level of vibrations cause by a veritable intrusion, causes the actuation through its corresponding timing circuit of an associated power circuit of said general alarm signal producing means.

* * * * *